US010850883B1

(12) United States Patent
Schulman

(10) Patent No.: US 10,850,883 B1
(45) Date of Patent: Dec. 1, 2020

(54) SUBJECTING PLASTIC FILM OVERHANGS TO PRESSURIZED, HEATED AIRSTREAMS THAT TIGHTEN THE PLASTIC FILM FOR OVERWRAPPED PACKS

(71) Applicant: Royal Consumer Products LLC, Norwalk, CT (US)

(72) Inventor: Steven A. Schulman, Norwalk, CT (US)

(73) Assignee: Royal Consumer Products LLC, Norwalk, CT (US)

( * ) Notice: Subject to any disclaimer, the term of this patent is extended or adjusted under 35 U.S.C. 154(b) by 0 days.

(21) Appl. No.: 16/654,008

(22) Filed: Oct. 16, 2019

Related U.S. Application Data

(60) Provisional application No. 62/891,953, filed on Aug. 26, 2019.

(51) Int. Cl.
*B65B 53/06* (2006.01)

(52) U.S. Cl.
CPC ..... *B65B 53/06* (2013.01)

(58) Field of Classification Search
CPC ..... B65B 53/06; B65B 53/063; B65B 53/066
USPC ..... 53/442, 557, 488; 206/497
See application file for complete search history.

(56) References Cited

U.S. PATENT DOCUMENTS 2,801,180 A * 7/1957 Rumsey ..... 426/412
3,402,475 A * 9/1968 Johansen ..... B65B 53/063 34/388
4,815,603 A * 3/1989 Harris ..... B65D 71/10 206/497
4,873,814 A * 10/1989 Harris ..... B65D 71/10 53/442
5,115,915 A * 5/1992 Harris ..... B65D 85/505 206/423
5,265,727 A * 11/1993 Anderson ..... B65D 75/002 206/457
5,329,745 A * 7/1994 Suga ..... B65B 9/067 53/75
5,546,677 A * 8/1996 Tolson ..... B65B 53/063 34/216
5,740,659 A * 4/1998 Cox ..... B65B 53/04 53/216
5,746,041 A * 5/1998 Tolson ..... B65B 53/06 53/442

(Continued)

OTHER PUBLICATIONS

How to use shrink centerfold roll, video demonstration by Pioneer Imports & Wholesale (PIW), published on Aug. 31, 2016, retrieved from URL https://www.youtube.com/watch?v=YFSX-Q8WJ68 on Jul. 7, 2020 (Year: 2016).*

(Continued)

*Primary Examiner* — Valentin Neacsu
(74) *Attorney, Agent, or Firm* — Robert J. Hess; Hess Patent Law Firm

(57) ABSTRACT

A method and apparatus that blows a heated airstream at overhanging portions of overwrapping plastic film to diminish same to without curling a product that is overwrapped by the plastic film. The overhang conforms in shape to a neighboring portion of a product. A conveyor conveys the plastic-overwrapped product to a heating section where the heated airstream is directed onto the overhanging portions of the plastic film.

12 Claims, 4 Drawing Sheets
(3 of 4 Drawing Sheet(s) Filed in Color)

(56) References Cited

U.S. PATENT DOCUMENTS

| | | | | |
|---|---|---|---|---|
| 5,787,682 | A * | 8/1998 | Tolson | B65B 53/063 53/442 |
| 9,969,511 | B2 * | 5/2018 | Newell | B65B 53/06 |
| 2004/0118503 | A1 * | 6/2004 | Record | F41H 3/00 156/85 |
| 2004/0195115 | A1 * | 10/2004 | Colombo | B65D 81/268 206/204 |
| 2014/0202117 | A1 * | 7/2014 | Newell | B65B 53/02 53/442 |
| 2014/0327968 | A1 * | 11/2014 | Krause | G02B 3/0037 359/619 |

OTHER PUBLICATIONS

"Board"—definition, by Merriam-Webster Online Dictionary, published online at URL https://www.merriam-webster.com/dictionary/board, retrieved on Sep. 6, 2020 (Year: 2020).*

Curl—Definition by Merriam-Webster Online Dictionary, retrieved from URL https://www.merriam-webster.com/dictionary/curl on Oct. 2, 2020 (Year: 2020).*

Susceptible—Definition by Merriam-Webster Online Dictionary, retrieved from URL https://www.merriam-webster.com/dictionary/susceptible on Oct. 2, 2020 (Year: 2020).*

Shrink Film 101, U.S. Packaging & Wrapping LLC, https://uspackagingandwrapping.com/shrink-film-101.html.

What Is Shrink Wrap?, U.S. Packaging & Wrapping LLC, https://uspackagingandwrapping.com/blog/what-is-shrink-wrap.html.

The Complete Guide to Shrink Film, Industrial Packaging, https://www.industrialpackaging.com/the-complete-guide-to-shrink-film.

How to Shrink Wrap, U.S. Packaging & Wrapping LLC, https://uspackagingandwrapping.com/how-to-shrink-wrap.html.

David Roberge, Common Shrink Wrap Problems and How to Solve Them, Industrial Packaging, Jun. 12, 2019, https://www.industrialpackaging.com/blog/common-shrink-wrap-problems-and-how-to-solve-them.

* cited by examiner

SUBJECTING PLASTIC FILM OVERHANGS TO PRESSURIZED, HEATED AIRSTREAMS THAT TIGHTEN THE PLASTIC FILM FOR OVERWRAPPED PACKS

CROSS REFERENCE TO COPENDING PATENT APPLICATION

The present application asserts the benefit of priority from provisional patent application No. 62/891,953 filed Aug. 27, 2019.

BACKGROUND OF THE INVENTION

(1) Field of the Invention

The invention relates to the application of pressurized, heated airstreams onto an underside of an excessive overhang of plastic film overwrapping a product in a manner sufficient to remove the excessive overhang and to tighten the plastic film and, if applicable, prevent curling of the product.

(2) Discussion of Related Art Including Information Disclosed Under 37 CFR 1.97 and 1.98

According to an online Wikipedia webpage at en.wikipedia.org/wiki/Overwrap, "plastic films" and "shrink wrap" are described as follows.

Plastic films, usually polyethylene or polypropylene (or polyolefin), can be wrapped around an item and attached with adhesive, PSA tape, or by heat sealing. Sometimes the film is in the form of a plastic bag which is sealed around the item.

Shrink wrap is a material made up of polymer plastic film. When heat is applied it shrinks tightly over whatever it is covering. Heat can be applied with a hand held heat gun (electric or gas) or the product and film can pass through a heat tunnel.

According to an online webpage at uspackagingandwrapping.com/shrink-film-10, polyolefin shrink film and polyethylene shrink film and their drawbacks are described as follows.

Polyolefin Shrink Film—A type of shrink wrap that has become the preferred choice for packaging products both edible and non-edible. Polyolefin Shrink wrap is preferred for a variety of reasons including: fewer odors when sealed, stronger seal, and more flexible storage. Polyolefin shrink films do not have any chlorine; therefore, they do not produce hydrogen chloride gas. Polyolefin shrink wrap does not have any plasticizers, so temperature is not an issue. Polyolefin can be stored in a wide range of temperatures and does not harden and soften in different environments like PVC shrink film.

Drawbacks of Polyolefin Shrink Film—Cost and machine compatibility are the two major drawbacks of Polyolefin shrink film. Polyolefin is commonly more expensive than PVC shrink wrap. Many packagers prefer PVC because of this reason. There are types of polyolefin shrink wraps that are more compatible with machines, but Polyolefin machine compatibility has been an issue of packagers.

Polyethylene Shrink Film—Polyethylene shrink film is used to package heavier products. Polyethylene shrink film (bundling film) is most often extruded onto single wound or flat rolls. The rolls are used on shrink bundling machines that have a sealing bar and shrink tunnel.

Drawbacks of Polyethylene Shrink Film—Polyethylene shrink film requires a shrink bundling machine to efficiently run products. Shrink bundling machines with a shrink tunnel can be expensive and cost thousands. Polyethylene shrink film also requires longer heat exposure to fully shrink. Products sensitive to heat can melt or become damaged while the shrink film is obtaining a full shrink. Polyethylene shrink film has a low shrink rate of 15% or less. Product measurements are important to ensure the right size of roll is purchased. If the product is flexible or semi-flexible when heat is applied to the plastic, it will curl the product.

The present inventor has made some observations. When wrapping polyethylene film on products with conventional polyethylene overwrapping equipment, excessive overhangs form that extend outward from sides or edges of the product. These overhangs in effect bound a void that spaces apart a peripheral side edge of the plastic film from sides of the product that is overwrapped. Also, when subjecting the polyethylene film to heat and allowing to cool, shrinkage ensues in an uncontrolled manner that promotes curling of the product if the product is flexible or semi-flexible. Indeed, the polyethylene film may force the product to take on a tubular shape if allowed to shrink uncontrollably.

A plastic film overwrapped pack includes a plastic film, such as polyethylene film, that encloses or envelops a product that is either rigid, flexible or semi-flexible. Conventional, automatic polyethylene overwrapping equipment is used to wrap such a product with the polyethylene film. An alternative to wrapping with polyethylene film is to wrap products with other type of films, which cost more.

It is desired to devise a technique to eliminate such excessive overhang of plastic film from edges of a plastic overwrapped product in a neat appearing manner and yet avoid curling of the product if the product is flexible or semi-flexible.

SUMMARY OF THE INVENTION

The invention delivers pressurized, heated airstreams to an underside of excessive overhangs that extend from a side of a plastic film overwrapped pack. As a consequence, the excessive overhangs tighten and quickly disappear, i.e., the excessive overhangs become removed or eliminated as the plastic film tightens to becomes taut in that area that was impacted by the pressurized, heated airstream delivery by conforming in shape to the neighboring portion of the product that is overwrapped.

If the product happens to be flexible or semi-flexible, then the directing of the pressurized, heated airstream to the underside of the excessive overhangs and flow toward the fount or topside of the plastic film overwrapped pack will remove or eliminate the excessive overhangs without curling the product. The plastic film is preferably polyethylene film.

In addition, the pressurized, heated airstream delivery may be adjusted as to heat and pressure to take into account the dimensional size of excess polyethylene, the type of polyethylene, and speed of the product line.

BRIEF DESCRIPTION OF THE DRAWINGS

For a better understanding of the present invention, reference is made to the following description and accompanying drawings, while the scope of the invention is set forth in the appended claims.

The patent or application file contains at least one drawing executed in color. Copies of this patent with color drawings will be provided by the Office upon request and payment of the necessary fee.

DESCRIPTION OF THE PREFERRED EMBODIMENT

Figure 1:
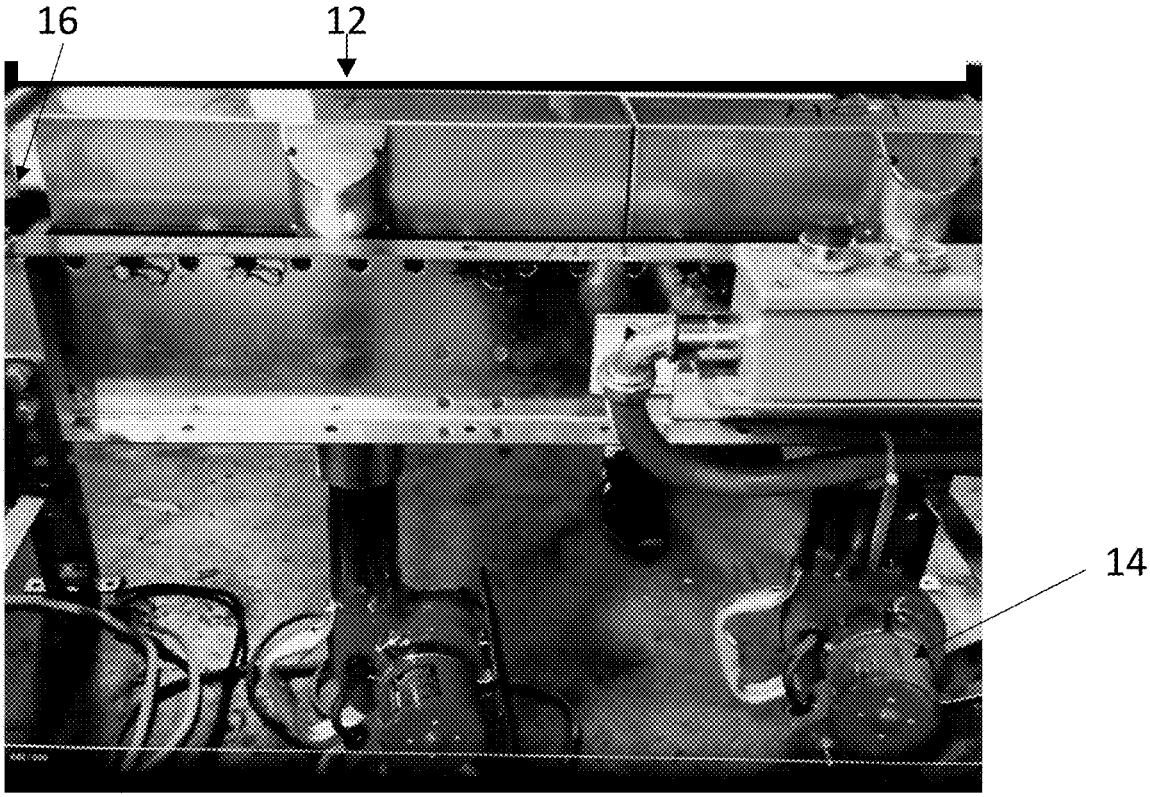
FIG. 1 is an elevational view of a conventional equipment that includes a conveyor and heating section. Plastic film that overwraps poster board is seen with excessive extensions that extend outward from the product overwrapped. The plastic overwrapped product is being conveyed by the conveyor to the heating section, which directs heated airstream to a nearby edge of the plastic film.
Figure 2:
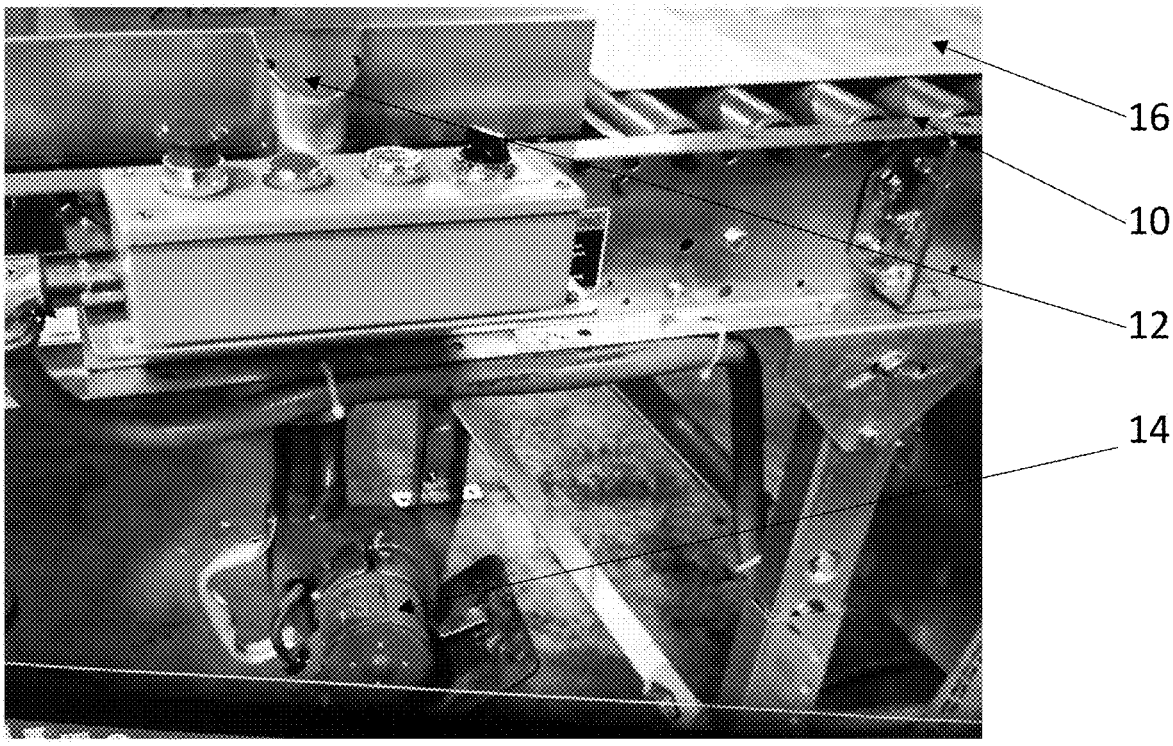
FIG. 2 is an elevational view as in FIG. 1 but showing there are no longer any plastic film overhangs present on the side where heated airstream had been applied.

Turning to the drawings, FIGS. 1 and 2 show a conventional conveyor 10 with rollers, a heating section 12, and a plastic film overwrapped pack 16. The heating section 12 includes conventional equipment to deliver pressurized, heated air, which conventional equipment includes adjustable heat equipment 14.

Figure 3:
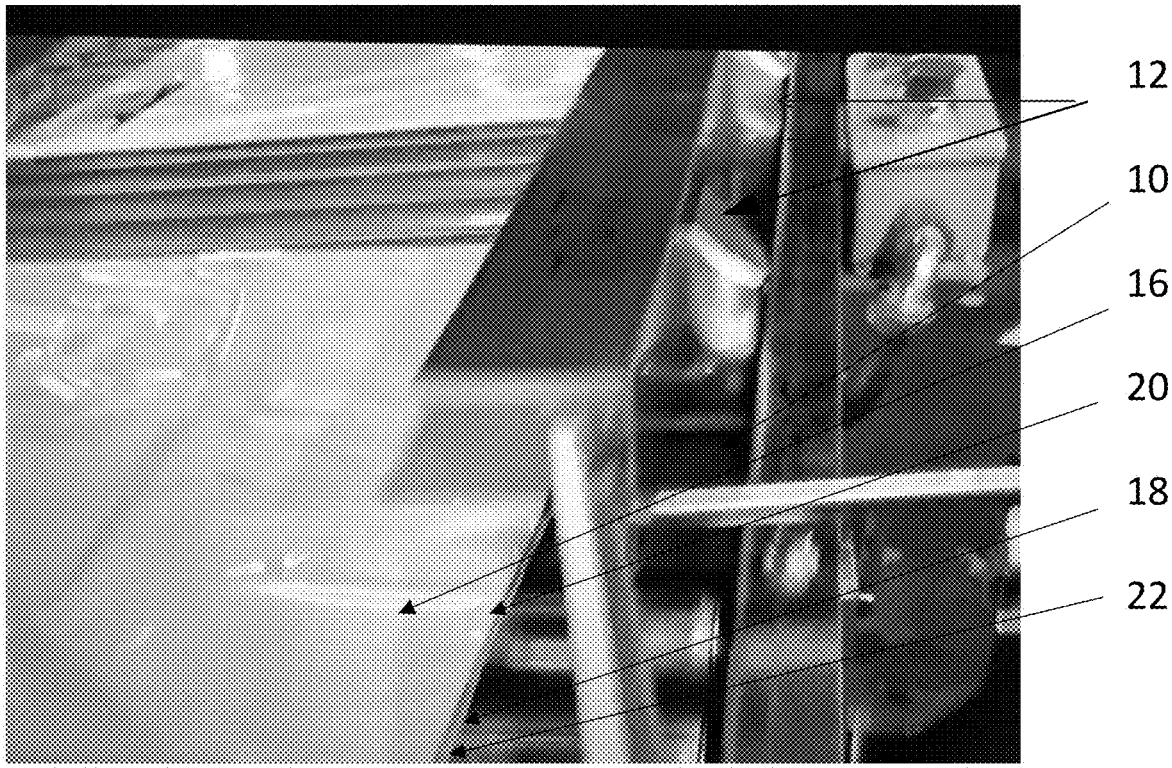
FIG. 3 is an isometric view of the plastic-overwrapped poster board on the conveyor prior to passing by the heating section.
Figure 4:
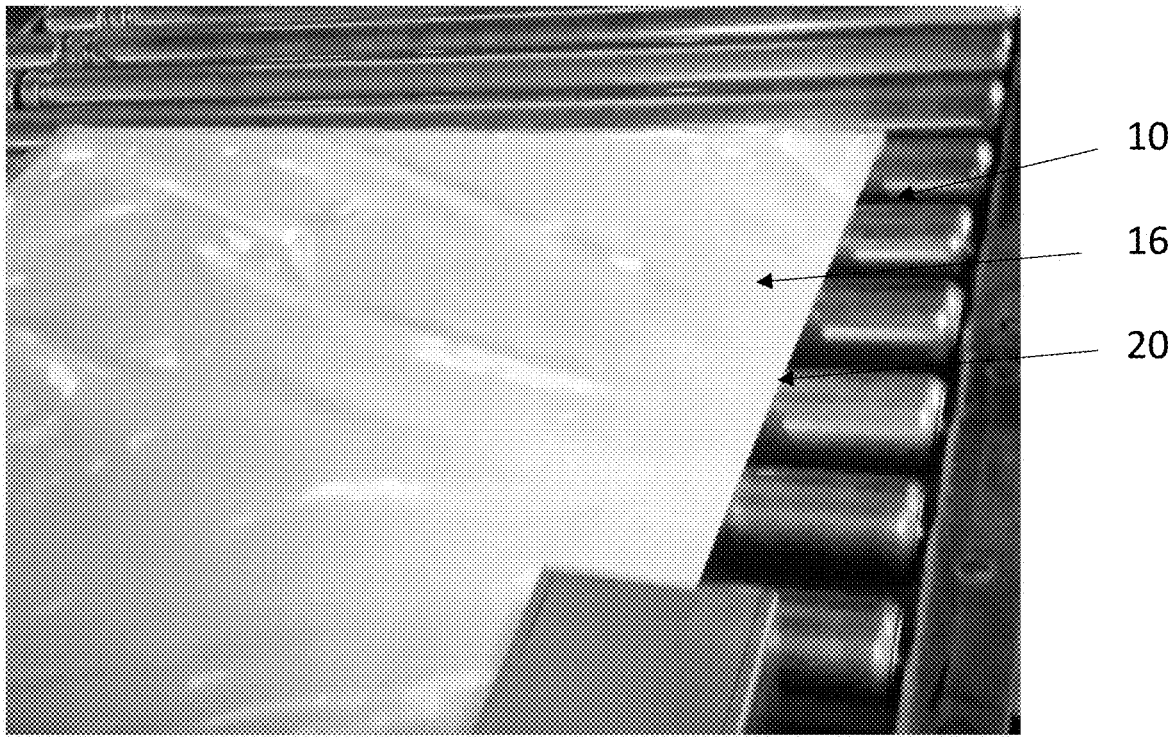
FIG. 4. Is an isometric view of the plastic-overwrapped poster board on the conveyor as in FIG. 3, but after passing the heating section.
Figure 5:
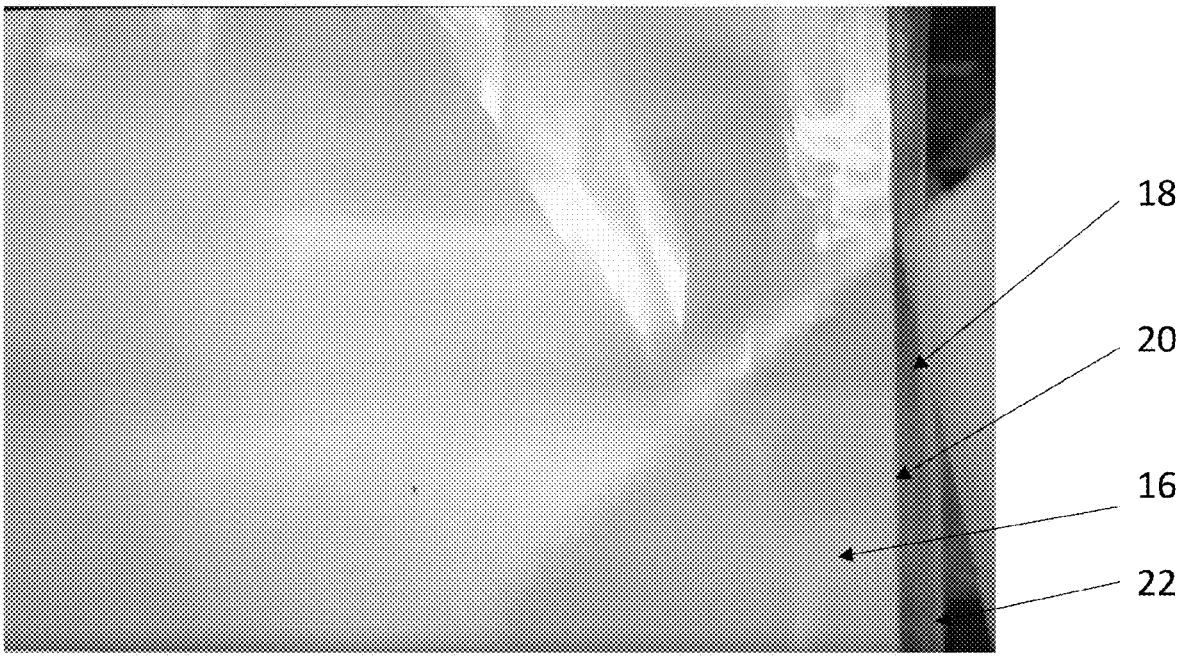
FIG. 5 is a top view of the plastic-overwrapped poster board on the conveyor prior to passing by the heating section.
Figure 6:
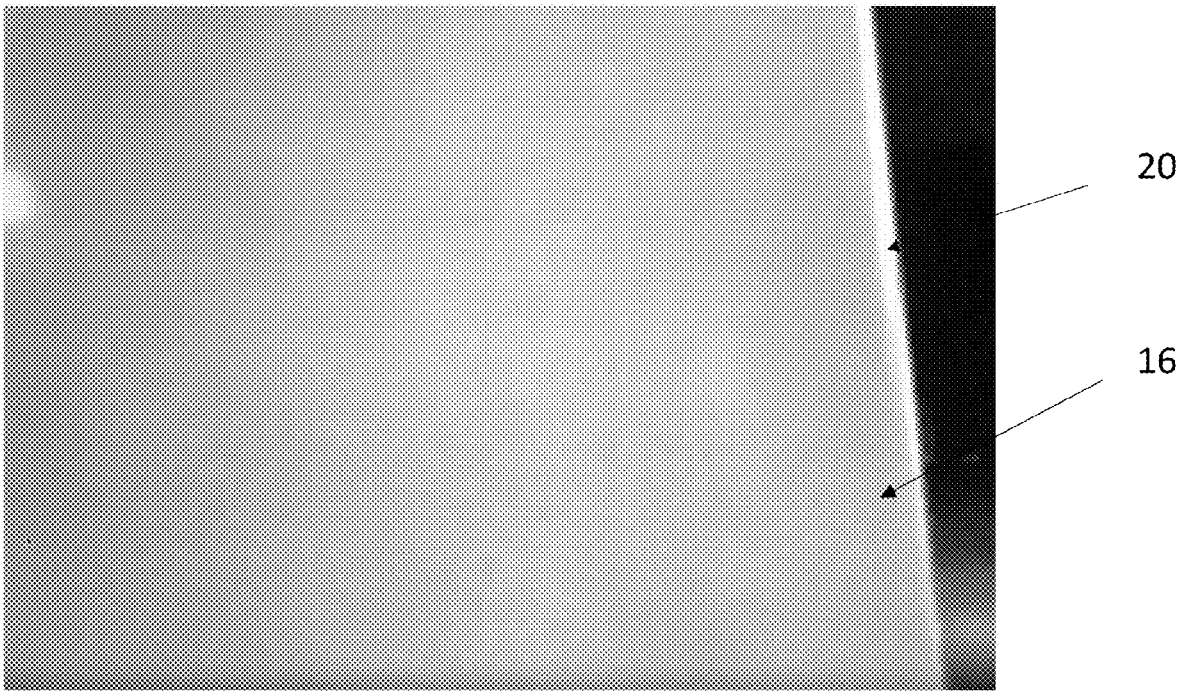
FIG. 6 is a top view of the plastic-overwrapped poster board on the conveyor as in FIG. 5, but after passing the heating section.

FIGS. 3 and 5 show the plastic film overwrapped pack 16 before reaching the heating section 12 and FIGS. 4 and 6 show the plastic film overwrapped pack 16 after passing the heating section 12. FIGS. 3 and 5 show an excessive overhang 18 of the plastic film extending outward from a side 20 of the product that is overwrapped to a side periphery 22 of the plastic film. A void bounded by the excessive overhang 18 separates the side periphery 22 of the plastic from the side 20 of the product that is overwrapped.

Figure 7:
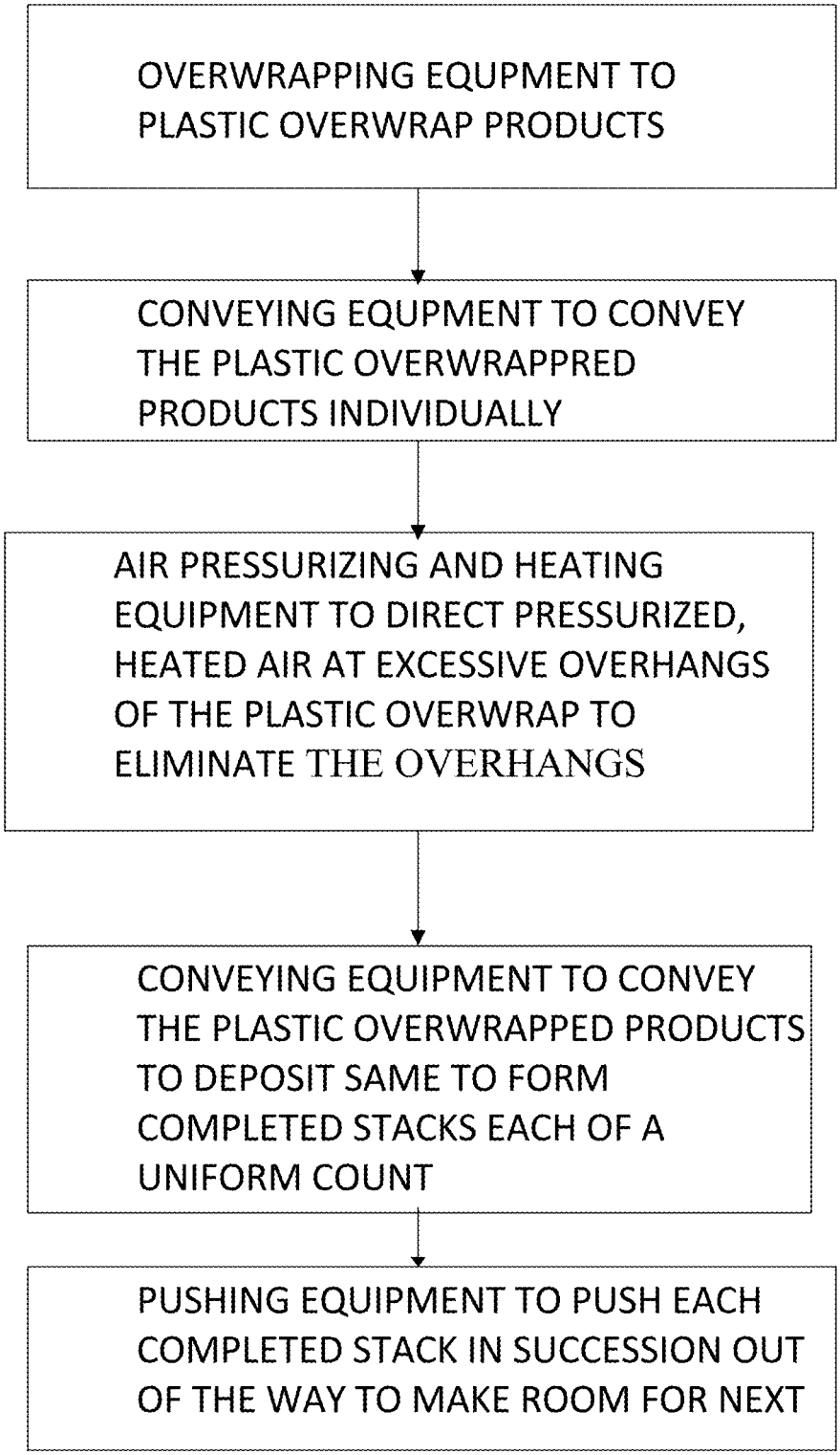
FIG. 7 is a flow diagram that indicates the path that the plastic-overwrapped product travels between stations in a production line.

FIG. 7 shows the path that the plastic film overwrapped packs 16 travels from a station having automatic overwrapping equipment to a station equipped with the heating section 12 and then to a station that stacks the overwrapped products. The heating section 12 is downstream from the automatic overwrapping equipment. Preferably, the automatic overwrapping equipment wraps the product with polyethylene film (or wrap) in a manner that encloses or envelops the product and thereby yields the plastic film overwrapped product.

After overwrapping a product with plastic film in a conventional manner with the conventional automatic overwrapping equipment to form the plastic film overwrapped packs, plastic film overhangs 18 form, which extend outward from each side of the plastic film overwrapped product 16 so that the overhanging plastic film bounds a void that separates the side 20 from a side peripheral edge 22 of the plastic film. Such can be seen in FIGS. 3 and 5.

By applying sufficiently heated airstream at the overhanging portions 18 of the plastic film under sufficient pressure (such as in a concentrated manner via a jet of airstream emerging from nozzles), the overhanging portions 18 shrink onto the side 20 of product being overwrapped to tighten and become taut and thereby give a neat appearance. Such is apparent in FIGS. 4 and 6. If the product is flexible or semi-flexible, curling of the poster board is avoided by this technique because the shrinkage of the plastic film is controlled through the limiting of exposure of the overwrapped plastic film to the heated air, i.e., essentially, only the overhanging portions 18 of the plastic film are exposed to the heated airstream directly as opposed to subjecting the entire overwrapped plastic film simultaneously to heated air.

The heating equipment 14 in the heating section 12 should be adjustable to accommodate variations in heat demand depending upon size of excess polyethylene, type of polyethylene, and speed of the production line. The adjustability should enable delivery of a sufficient amount of heat over a period of time to eliminate excess overhang of the polyethene film by shrinking the polyethylene film. Polyethylene film normally shrinks in an uncontrollable manner so as to give rise to wrinkles and, when the plastic overwrapped product is semi-flexible or fully flexible, causes the plastic overwrapped product (such as poster board) to curl.

In particular, the delivery of pressurized, heated airstream in accordance with the invention applies to plastic film overwrapped packs. The plastic film may be of any kind of conventional plastic films, although polyethylene film is preferred. The product within the packs may be of any kind, whether rigid, flexible or semi-flexible. Examples of flexible or semi-flexible products include poster boards and foam boards. An example of a rigid product would be a dry erase board. An economic benefit of the invention resides in the realization of a tight package that uses a type of plastic film (polyethylene) that is cheaper than others such as polyolefin film.

The heating equipment may be any conventional hair dryer that blows heated airstream to produce one package every ten minutes. However, a conventional hair dryer is not suitable for use in mass production purposes. Instead, the equipment should include industrial heaters with air volume control, heat control, speed of production and other factors. Preferably, such industrial heaters and air blowers are within the heating section 12 (FIGS. 1-4) located downstream of the automatic polyethylene overwrapping equipment (FIG. 7). The conventional conveyor 10 (FIG. 2-4) may be used that has rollers to convey the overwrapped product from the automatic polyethylene overwrapping equipment to the heating section (FIG. 7).

Turning to FIGS. 1-2, pressurized, heated airstream is directed to impinge at only at an underside of an overhang that extends outward from one the sides of the plastic film overwrapped pack 16. Such may be done via air nozzles that allow jets of air to emerge as the pressurized, heated air. The pressurized, heated airstream would not be directed at an entirety of the plastic film at the same time that is overwrapping the product in the pack.

As a result, there is an elimination or removal of the overhangs or at least a diminishment of them and there should be a tightening of the plastic-overwrap to conform with a shape of a portion of the product within that is overwrapped. Applying the pressurized, heated air to even just one side of the plastic film overwrapped pack 16 will be effective in tightening the plastic film and in reduction of wrinkling otherwise present. Applying pressurized, heated airstreams to more sides where there are overhangs will be even more effective in tightening the plastic film to conform a shape of a portion of the product overwrapped to eliminate or remove more of the excessive overhangs that extend from those sides.

A conventional air blower may be used to pressurize the heated airstream by channeling it accordingly to emerge from a nozzle. A conventional heater or drier is used as part of the heating equipment 14 to heat the air. The temperature of the heated airstream may be the same as that known conventionally to cause shrinkage of polyethylene plastic film.

Turning to FIG. 7, the path that the plastic film overwrapped packs 16 travel in a production line via conveying equipment is shown from a station that overwraps the product with the plastic film to a station having the heating section 12 (FIGS. 1-4) to eliminate the excessive overhangs 18 of plastic film and then to a drop-down station to stack the plastic film overwrapped packs 16. The conveying equipment may include conveyors 10 (FIG. 2-4) with rollers over which the plastic film overwrapped packs 16 travel. The conveying equipment is responsible for conveying the plastic film overwrapped packs 16 from the overwrapping station to the heating section 12 and then from the heating section 12 to a drop-down area that allows the plastic overwrapped products to stack one on top of the other. A conventional counter may be used to count the number of plastic film overwrapped packs that are forming the stack and, when a uniform count is reached, trigger pushing equipment to push the stack away in succession to make room for a successive stack to be formed.

While the foregoing description and drawings represent the preferred embodiments of the present invention, it will be understood that various changes and modifications may be made without departing from the scope of the present invention.

The invention claimed is:

1. A method of tightening an overhang of plastic film overwrapping an entirely planar product, comprising the steps of:

(i) overwrapping the product in the plastic film so that an overhanging portion of the plastic film is formed extending from a side of the product, spacing apart a side periphery of the plastic film from a neighboring portion of the product, the overwrapped product being susceptible to curling if subjected to heating over an entirety of the overwrapped product;

(ii) controlling shrinkage of the plastic film overwrapping the product so that the overwrapped product remains entirely planar, by exposing the overhanging portion to heat from a heated airstream of a heating section in a manner that (a) tightens the overhanging portion to conform to a shape of the neighboring portion of the product, and (b) avoids curling the product; and (iii) carrying out the controlling of the shrinkage of the plastic film without subjecting an entirety of the plastic film simultaneously to heated air that would cause shrinkage of the entirety of the plastic film.

2. The method of claim 1, further comprising:

conveying the overwrapped product from where the overwrapping occurred to the heating section.

3. The method of claim 1, wherein the plastic film is polyethylene film.

4. The method of claim 1, wherein the product is a pack selected from the group consisting of poster boards and foam boards.

5. The method of claim 1, wherein the product has a surface whose entirety is flat.

6. The method of claim 1, wherein the heating section is configured to channel the heated airstream to a side of the overwrapped package where the overhanging portion resides by passing the heated airstream through a component, the component having a portion through which the heated airstream passes and having a portion elevated that extends over the side periphery of the plastic film.

7. An apparatus to tighten an overhang of plastic film that overwraps an entirely planar product, comprising:

equipment configured to overwrap the product with the plastic film so that an overhanging portion is formed extending from a side of the product, spacing apart a side periphery of the plastic film from a neighboring portion of the product, the overwrapped product being susceptible to curling if subjected to heating over an entirety of the overwrapped product;

a heating section configured to control shrinkage of the plastic film overwrapping the product, by exposing the overhanging portion to heat from a heated airstream in a manner that (a) tightens the overhanging portion to conform to a shape of a neighboring portion of the product and (b) avoids curling the overwrapped product; and wherein the heating section is configured to carry out the controlling of the shrinkage of the plastic film in a way that the overwrapped product remains entirely planar, without an entirety of the plastic film being subjected simultaneously to heated air that would cause shrinkage of the entirety of the plastic film.

8. The apparatus of claim 7, further comprising a conveyor configured to convey the overwrapped product from where the overwrapping of the product occurs to the heating section.

9. The apparatus of claim 7, wherein the plastic film is polyethylene film.

10. The apparatus of claim 7, wherein the product is selected from the group consisting of poster boards and foam boards.

11. The apparatus of claim 7, wherein the product has a surface whose entirety is flat and bounded by edges.

12. The apparatus of claim 7, wherein the heating section is configured to channel the heated airstream to a side of the overwrapped package where the overhanging portion resides by passing the heated airstream through a component, the component having a portion through which the heated airstream passes and having a further portion elevated that extends over the side periphery of the plastic film.

* * * * *